US011383542B2

(12) United States Patent
Kitagishi et al.

(10) Patent No.: US 11,383,542 B2
(45) Date of Patent: Jul. 12, 2022

(54) RECORDING SYSTEM PROVIDING A NOTIFICATION ON A TIME TO REPLACE AN ADHESIVE LAYER ON A TRANSPORTING BELT, RECORDING DEVICE, AND CONTROL METHOD

(71) Applicant: SEIKO EPSON CORPORATION, Tokyo (JP)

(72) Inventors: Mikio Kitagishi, Matsumoto (JP); Katsuya Asamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 127 days.

(21) Appl. No.: 17/023,664

(22) Filed: Sep. 17, 2020

(65) Prior Publication Data

US 2021/0086537 A1 Mar. 25, 2021

(30) Foreign Application Priority Data

Sep. 19, 2019 (JP) ..... JP2019-170206

(51) Int. Cl.

| | |
|---|---|
| ***B41J 29/46*** | (2006.01) |
| ***B41J 13/08*** | (2006.01) |
| ***B41J 15/04*** | (2006.01) |
| ***B41J 11/00*** | (2006.01) |
| *B41J 2/01* | (2006.01) |

(52) U.S. Cl.

CPC ..... *B41J 29/46* (2013.01); *B41J 11/007* (2013.01); *B41J 13/08* (2013.01); *B41J 15/048* (2013.01); *B41J 2/01* (2013.01); *B65H 2301/44335* (2013.01); *B65H 2404/5391* (2013.01); *B65H 2515/704* (2013.01); *B65H 2515/842* (2013.01)

(58) Field of Classification Search

None

See application file for complete search history.

(56) References Cited

U.S. PATENT DOCUMENTS

2008/0238977 A1* 10/2008 Nishizaki ..... B41J 11/007 347/104
2014/0253622 A1* 9/2014 Momose ..... B65H 5/021 347/101

(Continued)

FOREIGN PATENT DOCUMENTS

EP 2756957 B1 * 3/2017 ..... B41J 11/007
JP 2006-315824 A 11/2006
JP 2006315824 A * 11/2006

OTHER PUBLICATIONS

JP Publication JP-2006315824-A English Translation, Abstract, pp. 2-3 (Year: 2006).*

*Primary Examiner* — Miya J Williams
(74) *Attorney, Agent, or Firm* — Workman Nydegger

(57) ABSTRACT

A recording system includes a recording device including a recording unit that performs recording onto a medium, a transporting belt that includes an adhesive layer and transports the medium stuck on the adhesive layer, a drive unit that drives the transporting belt, a control unit that includes a detection unit for detecting a load current flowing in the drive unit and that controls the drive unit. The recording system further includes a peeling device that peels the medium from the transporting belt, and a notification device that provides a notification. The control unit causes the notification device to provide a notification on a time to replace the adhesive layer, based on a detection result of the detection unit.

6 Claims, 5 Drawing Sheets

(56) References Cited

U.S. PATENT DOCUMENTS

| | | | | |
|---|---|---|---|---|
| 2015/0070431 | A1* | 3/2015 | Nakamura | B41J 11/0095 347/16 |
| 2015/0375539 | A1* | 12/2015 | Nakamura | B41J 13/0009 347/16 |

* cited by examiner

RECORDING SYSTEM PROVIDING A NOTIFICATION ON A TIME TO REPLACE AN ADHESIVE LAYER ON A TRANSPORTING BELT, RECORDING DEVICE, AND CONTROL METHOD

The present application is based on, and claims priority from JP Application Serial Number 2019-170206, filed Sep. 19, 2019, the disclosure of which is hereby incorporated by reference herein in its entirety.

BACKGROUND

1. Technical Field

The present disclosure relates to a recording system, a recording device, and a control method.

2. Related Art

JP-A-2006-315824 describes a recording device that includes a transporting belt including an adhesive layer, a recording unit configured to perform recording on a medium stuck on the adhesive layer, and a detection unit for detecting an adhesive force of the adhesive layer. When the transporting belt circles while contacting the adhesive layer, the detection unit rotates as the transporting belt circles. At this time, when the adhesive force of the adhesive layer decreases, the rotational speed of the detection unit decreases. Thus, in the recording device described in JP-A-2006-315824, the adhesive force of the adhesive layer is detected based on the rotational speed of the detection unit. The recording device notifies a replacement time of the adhesive layer, based on a detection result of the detection unit.

In the recording device described in JP-A-2006-315824, when the adhesive force of the adhesive layer is detected, the adhesive force of the adhesive layer may decrease due to contact of the detection unit with the adhesive layer.

SUMMARY

A recording system that solves the above-described problem includes a recording device including a recording unit configured to perform recording onto a medium, a transporting belt including an adhesive layer and configured to transport the medium stuck on the adhesive layer, a drive unit configured to drive the transporting belt, a control unit that includes a detection unit configured to detect a load current flowing in the drive unit and that controls the drive unit. The recording system further includes a peeling device configured to peel the medium from the transporting belt, and a notification device configured to provide a notification. The control unit causes the notification device to provide a notification on a time to replace the adhesive layer, based on a detection result of the detection unit.

A recording device that solves the above-described problem is a recording device in which a medium is collected by a peeling device, and the recording device includes a recording unit configured to perform recording onto the medium, a transporting belt including an adhesive layer and configured to transport the medium stuck on the adhesive layer, a drive unit configured to drive the transporting belt, a control unit including a detection unit configured to detect a load current flowing in the drive unit, and configured to control the drive unit, and a notification unit configured to provide a notification, where the control unit causes the notification unit to provide a notification on a time to replace the adhesive layer, based on the load current flowing in the drive unit when the medium is peeled from the transporting belt.

A control method that solves the above-described problem is a control method for a recording device including a recording unit configured to perform recording onto a medium, a transporting belt including an adhesive layer and configured to transport the medium stuck on the adhesive layer, and a drive unit configured to drive the transporting belt, and includes detecting a load current flowing in the drive unit when the medium is peeled from the transporting belt, and providing a notification on a time to replace the adhesive layer, based on a value of the detected load current.

DESCRIPTION OF EXEMPLARY EMBODIMENTS

One exemplary embodiment of a recording system will be described below with reference to the accompanying drawings.

Figure 1:
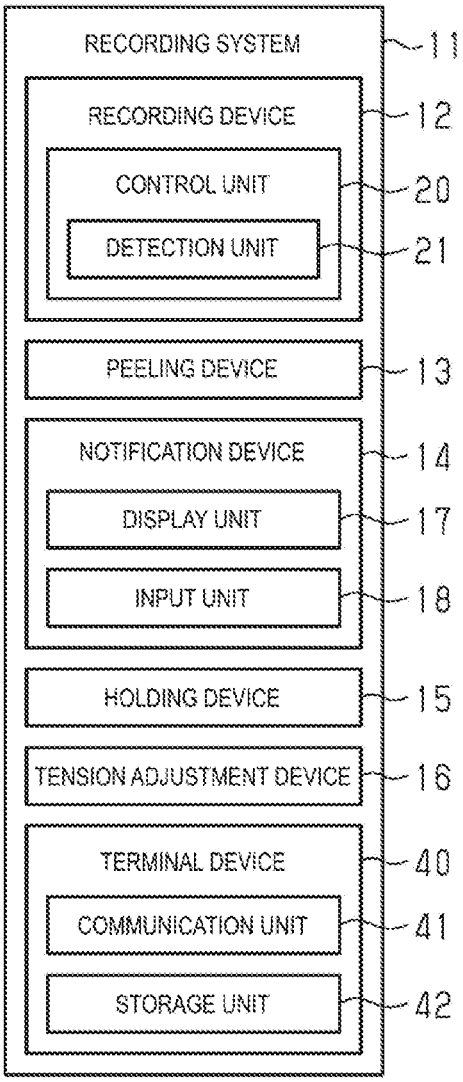
FIG. 1 is a block diagram illustrating one exemplary embodiment of a recording system.

As illustrated in FIG. 1, a recording system 11 includes a recording device 12, a peeling device 13, and a notification device 14. The recording system 11 according to the present exemplary embodiment includes a holding device 15, a tension adjustment device 16, and a terminal device 40 capable of communicating with the recording device 12.

The notification device 14 according to the present exemplary embodiment includes a display unit 17 and an input unit 18.

The display unit 17 displays information. The display unit 17 is, for example, a liquid crystal display. The notification device 14 notifies a user by displaying various types of information on the display unit 17.

The input unit 18 is configured to receive an input of an instruction. Thus, when the user operates the recording system 11, the user inputs an instruction to the input unit 18. The instruction input to the input unit 18 is input to the recording device 12 through the notification device 14.

The input unit 18 is, for example, a touch panel. Thus, in the present exemplary embodiment, the display unit 17 and the input unit 18 are integrally formed. The input unit 18 may be, for example, a mouse, a keyboard, or the like.

The recording device 12 is, for example, an ink jet-type printer that records an image such as characters and photographs on a medium 99 such as a fiber and a sheet by discharging ink, which is one example of a liquid.

The recording device 12 includes a control unit 20. The control unit 20 comprehensively controls the recording device 12, for example. The control unit 20 can communicate with the peeling device 13, the notification device 14, the holding device 15, the tension adjustment device 16, and the terminal device 40. The control unit 20 may control the peeling device 13, the notification device 14, the holding device 15, the tension adjustment device 16, and the terminal device 40.

The terminal device 40 includes a communication unit 41 for communicating with the recording device 12, and a storage unit 42 configured to store software for editing image data to be transmitted to the recording device 12. The communication unit 41 can transmit job data and various types of data related to image data to the recording device 12 via a wired or wireless network. The storage unit 42 includes a non-volatile storage medium such as an SSD and an HDD, and can store image data and various types of data. Further, the terminal device 40 is electrically coupled to the notification device 14, and can perform editing of image data and the like via the notification device 14.

Note that the notification device 14 may be included in the terminal device 40 or may be independent of the terminal device 40. When the notification device 14 is independent of the terminal device 40, the notification device 14 can perform information communication with the terminal device 40 by using a communication cable or the like.

The control unit 20 can be constituted as α: one or more processors configured to execute various types of processing in accordance with a computer program, β: one or more dedicated hardware circuits configured to execute at least a part of processing of various types of processing, such as an application specific integrated circuit, or γ: a circuit including a combination thereof. The processor includes a CPU and a memory such as a RAM and a ROM, and the memory is configured to store a program code or a command configured to cause the CPU to execute the processing. The memory, namely, a computer readable medium includes any readable medium that can be accessed by a general-purpose or dedicated computer.

The control unit 20 includes a detection unit 21. The detection unit 21 is, for example, a motor driver. In this case, in the control unit 20, the motor driver and the processor may be disposed on the same chip, or may be disposed on different chips. An operation of the control unit 20 including the detection unit 21 will be described below in detail.

Figure 2:
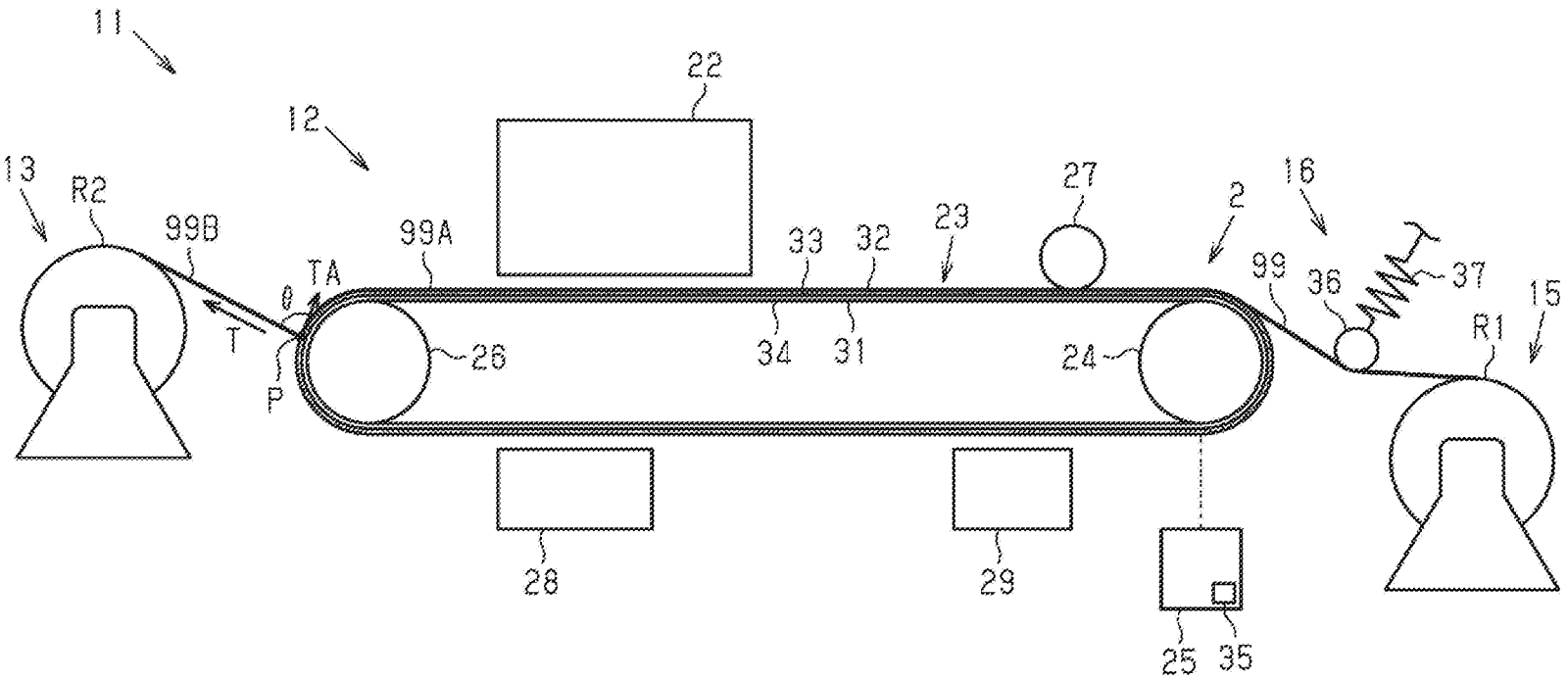
FIG. 2 is a side view schematically illustrating a recording system.

As illustrated in FIG. 2, the recording device 12 includes a recording unit 22, a transporting belt 23, a driving roller 24, a drive unit 25, and a driven roller 26. The recording device 12 according to the present exemplary embodiment includes a pressing portion 27, a cleaning portion 28, and a drying portion 29.

The recording unit 22 discharges liquid onto the medium 99, for example. As a result, the recording unit 22 performs recording on the medium 99. The recording unit 22 is, for example, a head. The recording unit 22 may be a serial head that scans with respect to the medium 99, or may be a line head that extends across approximately the same range as a width of the medium 99.

Note that the recording unit 22 is not limited to an ink jet-type, and may be an electrophotographic type in which an image and the like are fixed to the medium 99 by various photosensitive means after applying a solid toner.

The recording device 12 includes a transporting unit 2. The transporting unit 2 includes the transporting belt 23, the driving roller 24, and the driven roller 26. The transporting belt 23 includes a base material 31 and an adhesive layer 32.

The base material 31 is provided in an endless shape. The base material 31 includes a first surface 33 and a second surface 34 being a surface opposite to the first surface 33. The first surface 33 is a surface serving as an outer circumferential surface of the base material 31. The second surface 34 is a surface serving as an inner circumferential surface of the base material 31.

The adhesive layer 32 is provided on the first surface 33. The adhesive layer 32 has adhesion. The adhesive layer 32 is formed of an adhesive having adhesion. The adhesive layer 32 is formed by applying the adhesive onto the first surface 33. The adhesive layer 32 is formed around the entire circumference of the first surface 33. An adhesive force of the adhesive layer 32 decreases with use of the recording device 12, a passage of time, and the like.

The adhesive layer 32 is a layer to which the medium 99 is stuck. In other words, the transporting belt 23 transports the medium 99 stuck on the adhesive layer 32. The medium 99 is recorded by the recording unit 22 while being transported by the transporting belt 23. Thus, the recording unit 22 is located so as to face the first surface 33 with respect to the base material 31. The recording unit 22 according to the present exemplary embodiment is located above the transporting unit 2.

The transporting belt 23 is provided in an endless shape. The transporting belt 23 according to the present exemplary embodiment is wound onto the driving roller 24 and the driven roller 26. As a result, the second surface 34 in the base material 31 contacts the driving roller 24 and the driven roller 26. The transporting belt 23 transports the medium 99 by circling. The transporting belt 23 circles around the driving roller 24 and the driven roller 26. In other words, the transporting belt 23 rotates about a central point of a virtual straight line that couples from the center of rotation of the driving roller 24 to the center of rotation of the driven roller 26.

The driving roller 24 is configured to be rotatable. The driving roller 24 is coupled to the drive unit 25.

The drive unit 25 is, for example, a motor. When the drive 25 drives, the driving roller 24 rotates. When the driving roller 24 rotates, the transporting belt 23 circles. In this way, the drive unit 25 transmits a driving force to the driving roller 24, and drives the transporting belt 23. The drive unit 25 according to the present exemplary embodiment can rotate the driving roller 24 in both directions of a first direction and a second direction being an opposite direction from the first direction. In other words, the transporting belt 23 can circle in both directions of a direction of transporting the medium 99 and a direction of reverse-transporting the medium 99.

The drive unit 25 includes an encoder 35. The encoder 35 is configured to detect the amount of rotation, a rotational speed, and the like of the driving roller 24. The encoder 35 allows the driving roller 24 to rotate accurately.

The driven roller 26 is configured to be rotatable. The driven roller 26 is driven as the transporting belt 23 circles. In other words, the driven roller 26 rotates with rotation of the drive roller 24.

The pressing portion 27 is located outside the transporting unit 2. As a result, the pressing portion 27 is located so as to face the first surface 33 with respect to the base material 31. The pressing portion 27 according to the present exemplary embodiment is located above the transporting unit 2.

The pressing portion 27 presses the medium 99 against the transporting belt 23. As a result, the medium 99 is stuck on the adhesive layer 32. The pressing portion 27 according to the present exemplary embodiment presses the medium 99 downward toward the transporting belt 23. The pressing portion 27 sequentially bonds the medium 99 to the adhesive layer 32 by the transporting belt 23 circling.

The pressing portion 27 is, for example, a rod. The pressing portion 27 may be a roller. The pressing portion 27 effectively bonds the medium 99 to the adhesive layer 32 by reciprocating in a predetermined distance on the circumferential surface of the transporting belt 23, for example.

The cleaning portion 28 is located outside the transporting unit 2. Thus, the cleaning portion 28 is located so as to face the first surface 33 with respect to the base material 31. The cleaning portion 28 according to the present exemplary embodiment is located below the transporting unit 2.

The cleaning portion 28 cleans the adhesive layer 32 by contacting the adhesive layer 32. The cleaning portion 28 according to the present exemplary embodiment contacts the transporting belt 23 from below. The cleaning portion 28 includes a brush that contacts the adhesive layer 32, for example. The cleaning portion 28 sequentially cleans the adhesive layer 32 by the transporting belt 23 circling.

In the recording device 12, as the recording unit 22 performs recording on the medium 99, the liquid may adhere to the adhesive layer 32. The cleaning portion 28 cleans the adhesive layer 32 in order to remove the liquid adhering to the adhesive layer 32.

The cleaning portion 28 according to the present exemplary embodiment cleans the adhesive layer 32 by using a cleaning liquid. The cleaning portion 28 cleans the adhesive layer 32 by, for example, bringing a brush wet with the cleaning liquid into contact with the adhesive layer 32. As a result, the liquid adhering to the adhesive layer 32 is effectively removed. In this case, when the cleaning portion 28 cleans the adhesive layer 32, the transporting belt 23 gets wet with the cleaning liquid. The cleaning liquid is, for example, water.

The drying portion 29 is located outside the transporting unit 2. Thus, the drying portion 29 is located so as to face the first surface 33 with respect to the base material 31. The drying portion 29 according to the present exemplary embodiment is located below the transporting unit 2.

The drying portion 29 dries the adhesive layer 32 wet with the cleaning liquid. The drying portion 29 dries the adhesive layer 32 by, for example, blowing hot air onto the transporting belt 23. The drying portion 29 according to the present exemplary embodiment blows hot air from below the transporting belt 23. The drying portion 29 sequentially dries the adhesive layer 32 wet with the cleaning liquid by the transporting belt 23 circling.

Next, a series of operations of the recording device 12 will be described while focusing on a specific region of the circumferential surface of the transporting belt 23.

First, the pressing portion 27 presses the medium 99 against the specific region of the circumferential surface of the transporting belt 23. Next, the recording unit 22 performs recording on the medium 99 stuck on the specific region. Next, the medium 99 stuck on the specific region is peeled from the transporting belt 23 by the peeling device 13. Next, the cleaning portion 28 cleans the specific region. Next, the drying portion 29 dries the specific region. Next, the pressing portion 27 presses the medium 99 again against the specific region. In this way, an image is sequentially recorded on the medium 99 by the transporting belt 23 circling.

Next, the holding device 15, the tension adjustment device 16, and the peeling device 13 will be described.

The holding device 15 holds a roll body on which the medium 99 is wound. The holding device 15 rotatably holds the roll body. The roll body held by the holding device 15 is a first roll body R1 on which the medium 99 before recording is wound. In the present exemplary embodiment, by driving the transporting belt 23, the medium 99 is unwound from the first roll body R1 held by the holding device 15. The unwound medium 99 is transported from the holding device 15 toward the recording device 12.

The tension adjustment device 16 includes, for example, a contact member 36 and an elastic member 37. The contact member 36 contacts the medium 99 between the holding device 15 and the recording device 12. The contact member 36 according to the present exemplary embodiment contacts a surface of the medium 99 on which the recording unit 22 performs recording. The contact member 36 may be, for example, a cylindrical rod or a roller.

The elastic member 37 has elasticity. The elastic member 37 is attached to the contact member 36. The elastic member 37 is, for example, a spring. The elastic member 37 stretches and contracts according to magnitude of tension applied to the medium 99 between the holding device 15 and the recording device 12. In other words, when the tension applied to the medium 99 is great, the elastic member 37 contracts. When the tension applied to the medium 99 is small, the elastic member 37 stretches. In this way, the tension adjustment device 16 adjusts the tension of the medium 99 between the holding device 15 and the recording device 12 to be substantially constant.

The peeling device 13 holds the roll body on which the medium 99 is wound. The peeling device 13 rotatably holds the roll body. The roll body held by the peeling device 13 is a second roll body R2 on which the medium 99 is wound after the medium 99 passes through the recording device 12. In the recording system 11, the peeling device 13 winds the medium 99 from the recording device 12. In other words, the peeling device 13 collects the medium 99. A driving force from a drive source (not illustrated), such as a motor, is transmitted to the peeling device 13, and the peeling device 13 winds the medium 99 from the recording device 12 with a predetermined rotational torque.

The peeling device 13 peels the medium 99 from the transporting belt 23. The peeling device 13 according to the present exemplary embodiment peels the medium 99 from the transporting belt 23 by rotating the second roll body R2. Specifically, the peeling device 13 peels the medium 99 at a peeling point P of the circumferential surface of the transporting belt 23 on the driven roller 26. Since a predetermined tension is applied to a medium 99B, which is a part of the medium 99 from the peeling point P to the peeling device 13, there is substantially no slack in the medium 99B. Here, a part of the medium 99 that is stuck on the adhesive layer 32 upstream of the peeling point P in the circling direction of the transporting belt 23 is referred to as a medium 99A. At this time, in the vicinity of the peeling point P, an angle formed by the medium 99A and the medium 99B, namely, a peeling angle θ is less than 90 degrees. In the present exemplary embodiment, the peeling angle θ decreases as the adhesive force of the adhesive layer 32 increases.

A tension T based on the adhesive force acting between the adhesive layer 32 and the medium 99 acts on the medium 99B being a part of the medium 99. The tension force T acts toward the peeling device 13 from the peeling point P. Here, since the peeling angle θ is less than 90 degrees, a component TA of components of the tension T along the medium 99A approaches the direction of reverse-transporting the medium 99. The component TA along medium 99A is represented by $T \times \cos\theta$. At this time, in other words, in a case in which a slippage does not occur between the driving roller 24 and the transporting belt 23, when the medium 99 is peeled from the transporting belt 23 by the peeling device 13, torque based on the component TA along the medium 99A acts so as to resist rotational torque of the driving roller 24. Therefore, the peeling of the medium 99 from the transporting belt 23 by the peeling device 13 is the resistance of the circling transporting belt 23. In other words, when the peeling device 13 peels the medium 99 from the transporting belt 23, a load is generated on the drive unit 25. When a load is generated on the drive unit 25, a load current corresponding to magnitude of the load flows to the drive unit 25.

The resistance that occurs in the drive unit 25 by the medium 99 being peeled from the transporting belt 23 increases as the adhesive force of the adhesive layer 32 increases. As a result, as the adhesive force of the adhesive layer 32 increases, a load current flowing in the drive unit 25 in order for the transporting belt 23 to output a target transport speed increases. Conversely, as the adhesive force of the adhesive layer 32 decreases, a load current flowing in the drive unit 25 in order for the transporting belt 23 to output a target transport speed decreases. In this way, when the medium 99 is peeled from the transporting belt 23, a load current corresponding to magnitude of the adhesive force flows to the drive unit 25. In other words, the load current is a current supplied to the drive unit 25 in order for the transporting belt 23 to output a target transport speed.

Next, an operation of the control unit 20 including the detection unit 21 will be described.

The control unit 20 controls the drive unit 25. The control unit 20 according to the present exemplary embodiment controls not only the drive unit 25, but also other configurations. By control of the control unit 20, the transporting belt 23 circles at a predetermined speed. As a result, the medium 99 is transported at a predetermined speed. The predetermined speed refers to a predetermined target transport speed.

The detection unit 21 detects a load current flowing in the drive unit 25. The control unit 20 causes the notification device 14 to notify a replacement time of the adhesive layer 32, based on a detection result of the detection unit 21. The detection result of the detection unit 21 is a load current flowing in the drive unit 25. In other words, the control unit 20 transmits a signal related to a replacement time of the adhesive layer 32 to the notification device 14, based on a load current flowing in the drive unit 25 when the medium 99 is peeled from the transporting belt 23. As a result, the notification device 14 notifies the replacement time of the adhesive layer 32.

When the adhesive force of the adhesive layer 32 decreases, the medium 99 is not correctly held on the transporting belt 23, and thus recording quality may be affected. Thus, the control unit 20 prompts the user to replace the adhesive layer 32 at appropriate timing by notifying a replacement time of the adhesive layer 32.

Note that, as a replacement operation of the adhesive layer 32, a new adhesive may be applied after all the old adhesive layer 32 remaining on the first surface 33 is removed by an organic solvent or the like, or a new adhesive may be added to a state where the old adhesive layer 32 remains on the first surface 33.

For example, when a load current detected by the detection unit 21 is greater than a set value, the control unit 20 causes the notification device 14 to notify a period of time in which the current adhesive layer 32 can be used, based on the load current. In this case, for example, the control unit 20 causes the display unit 17 to display the period of time in which the adhesive layer 32 can be used. The control unit 20 causes the display unit 17 to display, for example, a basis weight, an area, and the like of the recordable medium 99 as the period of time in which the adhesive layer 32 can be used. As a result, the user can realize when a replacement time of the adhesive layer 32 is. Alternatively, the user can realize how much more the medium 99 can be recorded in a state of a current adhesive force of the adhesive layer 32. In other words, when a load current detected by the detection unit 21 is greater than the set value, the control unit 20 causes the notification device 14 to notify when a replacement time of the adhesive layer 32 is.

Note that it is preferable that a correspondence relationship between an adhesive force of the adhesive layer 32, namely, a value of a load current, and a basis weight and an area of the recordable medium 99 is evaluated in advance by experimentation, simulations, or the like, and is stored as a correspondence table in a memory such as a RAM and a ROM and the storage unit 42 of the terminal device 40.

As a display representing a period of time in which the adhesive layer 32 can be used, a recommended period of time until replacement of the adhesive layer 32 is performed, a basis weight and an area of the recordable medium 99, and a gauge representing a level of an adhesive force, a warning display, and the like may be displayed. As the warning display, how much the adhesive force is currently decreasing is displayed on a gauge of a maximum adhesive force, and a message that recommends replacement of the adhesive layer 32 is then output. In this way, replacement of the adhesive layer 32 can be prevented from being performed at an unexpected timing by the user previously realizing when replacement of the adhesive layer 32 needs to be performed. Such a display can be displayed based on the correspondence table described above.

For example, when a load current detected by the detection unit 21 is equal to or less than the set value, the control unit 20 causes the notification device 14 to make a notification so as to prompt replacement of the adhesive layer 32. In this case, for example, the control unit 20 causes the display unit 17 to display a message that prompts replacement of the adhesive layer 32. As a result, the user can realize that a replacement time of the adhesive layer 32 is now, for example. In other words, when a load current detected by the detection unit 21 is equal to or less than the set value, the control unit 20 causes the notification device 14 to notify that a replacement time of the adhesive layer 32 is now.

The set value may be changeable by the user. In the present exemplary embodiment, the set value can be changed through the input unit 18. In the present exemplary embodiment, any of a first set value, a second set value, and a third set value can be set as the set value. The first set value is greater than the second set value, and the second set value is greater than the third set value.

Figure 3:
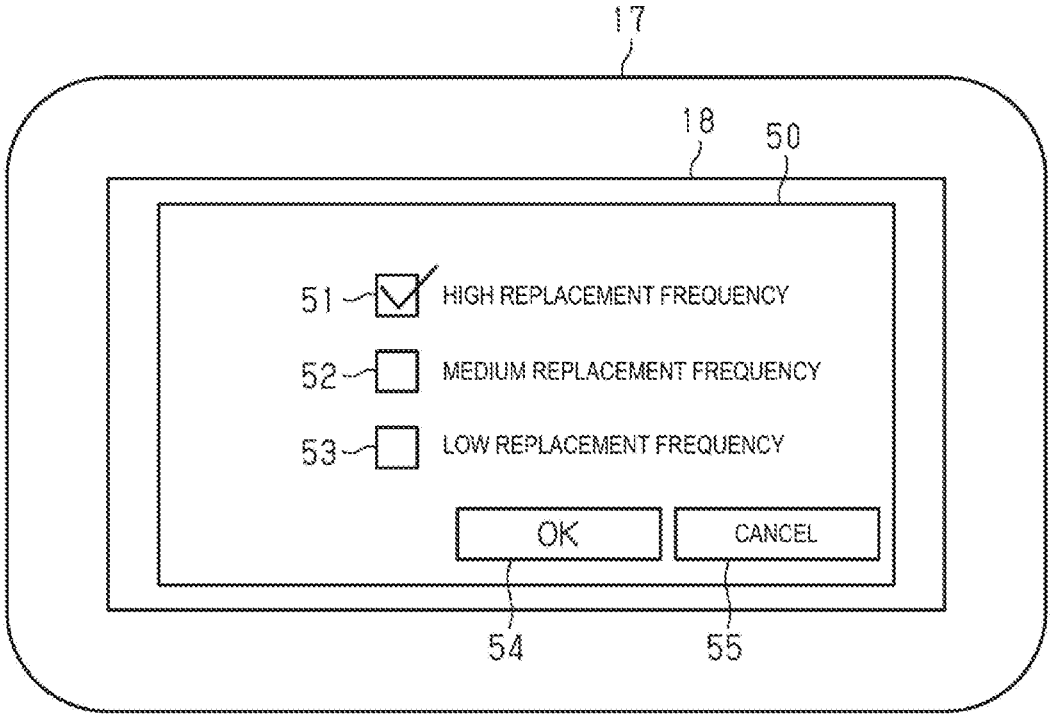
FIG. 3 is a schematic diagram illustrating one example of a change screen.

As illustrated in FIG. 3, in the present exemplary embodiment, when the set value is changed, the display unit 17 displays a change screen 50. The change screen 50 is a screen for changing the set value. In the change screen 50 according to the present exemplary embodiment, a first check box 51, a second check box 52, a third check box 53, an OK button 54, and a cancel button 55 are displayed.

The first check box 51 corresponds to a first set value. In the change screen 50, for example, "high replacement frequency" is displayed next to the first check box 51. In other words, when the first set value is set and a load current is equal to or less than the first set value, replacement of the adhesive layer 32 is prompted. The first set value is a value greater than the second set value and the third set value. Thus, when the first set value is set, a replacement frequency of the adhesive layer 32 increases. A state of a great adhesive force of the adhesive layer 32 is maintained by increasing the replacement frequency of the adhesive layer 32, and thus a state where recording quality is high can be maintained.

The second check box 52 corresponds to the second set value. In the change screen 50, for example, "medium replacement frequency" is displayed next to the second check box 52. In other words, when the second set value is set and a load current is equal to or less than the second set value, replacement of the adhesive layer 32 is prompted.

The third check box 53 corresponds to the third set value. In the change screen 50, for example, "low replacement frequency" is displayed next to the third check box 53. In other words, when the third set value is set and a load current is equal to or less than the third set value, replacement of the adhesive layer 32 is prompted. The third set value is a value smaller than the first set value and the second set value. Thus, when the third set value is set, a replacement frequency of the adhesive layer 32 decreases. One adhesive layer 32 can be used for an extended period of time by decreasing the replacement frequency of the adhesive layer 32. As a result, consumption of an adhesive can be suppressed.

The OK button 54 is a button that reflects a change in the set value. In other words, when the OK button 54 is pressed while any of the first check box 51, the second check box 52, and the third check box 53 is selected, the set value is changed.

The cancel button 55 is a button that cancels a change in the set value. When the cancel button 55 is pressed, the change screen 50 is closed.

In the present exemplary embodiment, the set value is a value determined with reference to a maximum load current, but may be a predetermined value. The maximum load current is a load current detected first for the adhesive layer 32 in detecting the adhesive force of the adhesive layer 32. In other words, the maximum load current is an initial value of a load current detected for the adhesive layer 32 in detecting the adhesive force of the adhesive layer 32.

The adhesive force of the adhesive layer 32 decreases as time passes. Therefore, a load current detected first is the greatest load current among a plurality of load currents detected for the adhesive layer 32 in detecting the adhesive force of the adhesive layer 32. The load current detected first is referred to as a maximum load current.

When the set value is determined with reference to the maximum load current, for example, the first set value may be set to a value of 80% of the maximum load current. For example, the second set value may be set to a value of 60% of the maximum load current. For example, the third set value may be a value of 40% of the maximum load current.

Next, one example of detection processing executed by the control unit 20 will be described. The control unit 20 according to the present exemplary embodiment executes the detection processing of detecting the adhesive force of the adhesive layer 32 simultaneously with recording of an image.

Figure 4:
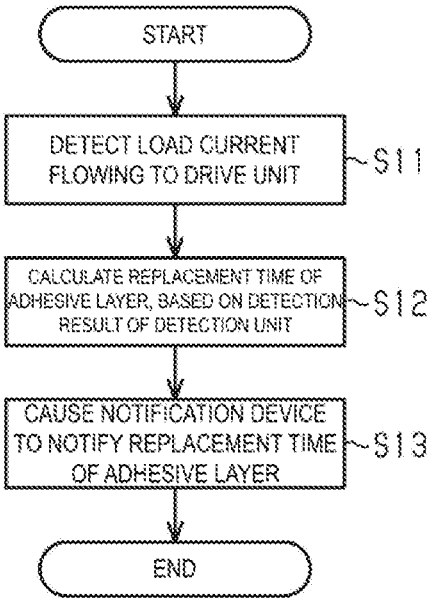
FIG. 4 is a flowchart illustrating one example of detection processing.

As illustrated in FIG. 4, in step S11, the control unit 20 detects a load current flowing in the drive unit 25. At this time, the control unit 20 detects the load current flowing in the drive unit 25 when the medium 99 is peeled from the transporting belt 23. For example, the control unit 20 detects the load current for a predetermined period of time. The control unit 20 may acquire an average value of the load current detected over the predetermined period of time, or may acquire the greatest value from the load current detected over the predetermined period of time.

In step S12, the control unit 20 calculates a replacement time of the adhesive layer 32, based on a detection result of the detection unit 21. In other words, in step S12, the control unit 20 calculates a replacement time of the adhesive layer 32, based on the value acquired in step S11. The control unit 20 according to the present exemplary embodiment refers to a set value in step S12.

In step S13, the control unit 20 causes the notification device 14 to notify the calculated replacement time of the adhesive layer 32. At this time, the control unit 20 transmits a signal related to the replacement time of the adhesive layer 32 to the notification device 14. In other words, in steps S12 and S13, the control unit 20 causes the notification device 14 to notify the replacement time of the adhesive layer 32, based on a value of the detected load current. When the processing in step S13 is finished, the control unit 20 ends the processing.

Next, one example of setting processing executed by the control unit 20 will be described. The control unit 20 executes the setting processing of setting a set value, for example, when the adhesive layer 32 is replaced. The control unit 20 according to the present exemplary embodiment executes the setting processing when completion of the replacement of the adhesive layer 32 is input to the input unit 18. In the present exemplary embodiment, the recording unit 22 does not operate during execution of the setting processing.

Figure 5:
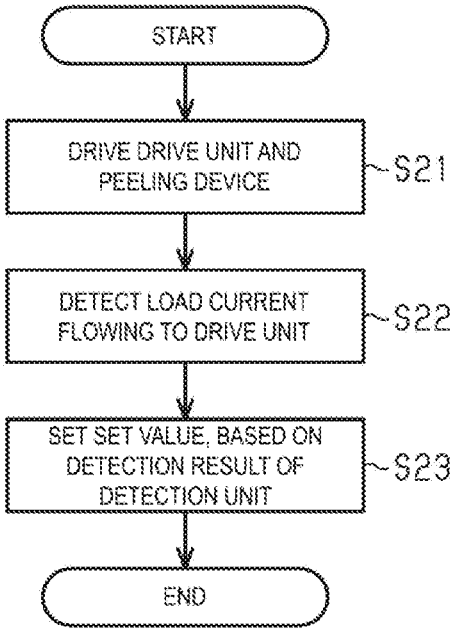
FIG. 5 is a flowchart illustrating one example of setting processing.

As illustrated in FIG. 5, in step S21, the control unit 20 drives the drive unit 25 and the peeling device 13. The transporting belt 23 circles by driving the drive unit 25. The second roll body R2 rotates by driving the peeling device 13. The medium 99 is sequentially peeled from the transporting belt 23 by driving the drive unit 25 and the peeling device 13.

In step S22, the control unit 20 detects a load current flowing in the drive unit 25. At this time, the recording unit 22 does not perform recording on the medium 99. Thus, in step S22, while an operation of the recording unit 22 is stopped, the control unit 20 detects the load current flowing in the drive unit 25 when the medium 99 is peeled from the transporting belt 23 by the peeling device 13. The load current detected in step S22 is a maximum load current for the replaced adhesive layer 32.

In step S23, the control unit 20 sets a set value, based on a detection result of the detection unit 21. In other words, the control unit 20 sets a set value with reference to the maximum load current acquired in step S22. For example, the control unit 20 sets 80% of the maximum load current as the set value. When the processing in step S23 is finished, the control unit 20 ends the processing.

Next, the functions and effects of the exemplary embodiment described above will be described.

(1) When the medium 99 is peeled from the transporting belt 23 by the peeling device 13, a load is generated on the drive unit 25. The load generated on the drive unit 25 appears as a load current flowing in the drive unit 25. The load generated on the drive unit 25 increases as an adhesive force of the adhesive layer 32 increases. Thus, the load current increases as the adhesive force of the adhesive layer 32 increases. In other words, when the adhesive force of the adhesive layer 32 decreases, the load current decreases.

In the exemplary embodiment described above, the control unit 20 includes the detection unit 21 configured to detect a load current flowing in the drive unit 25. The control unit 20 can detect an adhesive force of the adhesive layer 32 by detecting the load current flowing in the drive unit 25. In other words, the control unit 20 can detect the adhesive force without affecting the adhesive layer 32. Therefore, the recording system 11 can detect the adhesive force without decreasing the adhesive force of the adhesive layer 32.

(2) When completion of replacement of the adhesive layer 32 is input to the input unit 18, the control unit 20 detects a load current flowing in the drive unit 25 in a case in which the medium 99 is peeled from the transporting belt 23 by the peeling device 13 while an operation of the recording unit 22 is stopped. According to this configuration, when the adhesive layer 32 is replaced, the control unit 20 detects an adhesive force of the replaced new adhesive layer 32. In other words, the control unit 20 detects an initial value of the adhesive force of the new adhesive layer 32. As a result, the control unit 20 can detect a degree of decrease in the adhesive force with reference to the initial value of the adhesive force.

(3) A set value can be changed through the input unit 18. In this case, timing for prompting replacement of the adhesive layer 32 is changed by changing the set value. As a result, usability of a user improves.

(4) The recording system 11 includes the tension adjustment device 16 configured to adjust a tension of the medium 99 between the holding device 15 and the recording device 12 to be constant. In this case, by the tension adjustment unit 16 adjusting the tension of the medium 99 to be constant, a load generated on the drive unit 25 is constant by the medium 99 being unwound from the first roll body R1 regardless of the remaining amount of the medium 99. As a result, the control unit 20 can accurately detect the adhesive force, based on a load current.

In a case in which the recording system 11 does not include the tension adjustment device 16, a load current fluctuates in accordance with a weight of the first roll body R1. For example, when the first roll body R1 has a great weight, it is difficult to unwound the medium 99 from the first roll body R1, and thus a load applied to the drive unit 25 increases. For example, when the first roll body R1 has a small weight, the medium 99 is easily unwound from the first roll body R1, and thus a load applied to the drive unit 25 decreases. Thus, when the recording system 11 does not include the tension adjustment device 16, a load current easily fluctuates in accordance with a weight of the first roll body R1.

In the exemplary embodiment described above, in addition to a weight of the first roll body R1, contact of the pressing portion 27 with respect to the transporting belt 23, contact of the cleaning portion 28 with respect to the transporting belt 23, and the like are factors that provide a resistance to the drive unit 25. However, the pressing portion 27 and the cleaning portion 28 contact the transporting belt 23 with a constant force. As a result, contact of the pressing portion 27 and the cleaning portion 28 is less likely to contribute to a fluctuation in load current.

The present exemplary embodiment described above may be modified as follows. The present exemplary embodiment and modified examples thereof to be described below may be implemented in combination within a range in which a technical contradiction does not arise.

Figure 6:
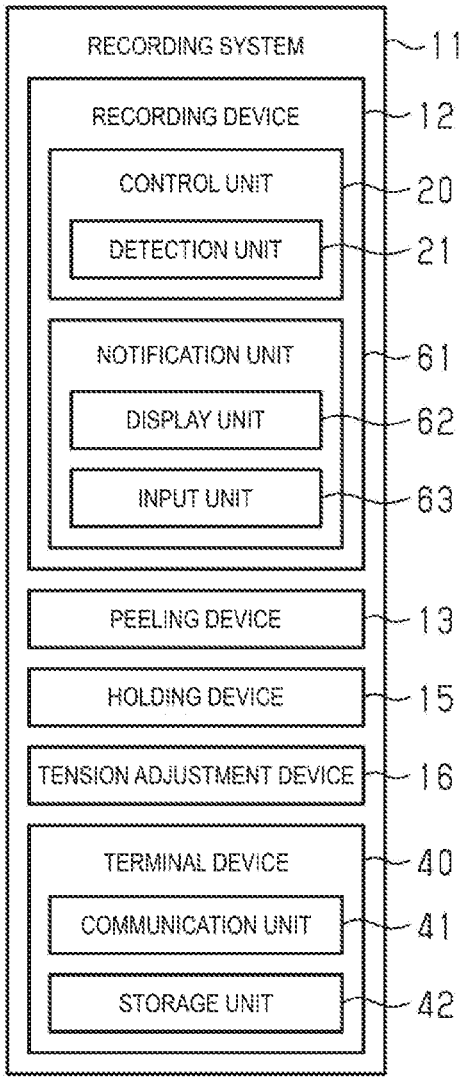
FIG. 6 is a block diagram illustrating a modified example of a recording device.

As illustrated in FIG. 6, the recording device 12 may include a notification unit 61 configured to make a notification. The notification unit 61 has the same function as that of the notification device 14. In this case, the recording system 11 may not include the notification device 14. In other words, instead of the notification device 14, the notification unit 61 may notify a replacement time of the adhesive layer 32. The notification unit 61 may include a display unit 62 configured to display information, and an input unit 63 configured to receive an input of an instruction. The recording device 12 can acquire an effect similar to that of the recording system 11 described above.

The notification device 14 is not limited to being displayed by the display unit 17, and may notify a replacement time of the adhesive layer 32 by producing a sound.

The control unit 20 may cause a replacement time to be notified, based on a plurality of set values. In this case, for example, when a detection result of the detection unit 21 is equal to or less than the first set value, the control unit 20 may notify a usable period of the adhesive layer 32 and, when a detection result of the detection unit 21 is equal to or less than the second set value, the control unit 20 may make a notification that prompts replacement of the adhesive layer 32.

The drive unit 25 and the peeling device 13 may be synchronized. In this case, the peeling device 13 rotates the second roll body R2 as the drive unit 25 is driven. As a result, the medium 99 is peeled from the transporting belt 23 without the peeling device 13 being controlled by the control unit 20.

The drive unit 25 and the holding device 15 may be synchronized. In this case, the holding device 15 rotates the first roll body R1 as the drive unit 25 is driven. A tension of the medium 99 can be adjusted by rotation of the first roll body R1. Thus, in the modified example, the tension adjustment device 16 is not necessary.

The structure of the tension adjustment device 16 is not limited to the exemplary embodiment described above. For example, a friction rod on which the medium 99 is wound may be employed as the tension adjustment device 16. The friction rod is acquired by attaching a high friction member such as rubber to a surface of a rod-like member or a cylindrical member made of metal, for example. An extension direction of the friction rod is parallel to an extension direction of the driving roller 24. The friction rod extends over a range greater than a maximum width of the medium 99 used in the recording device 12, and is also fixed so as not to rotate. In order to make the amount of the medium 99 wound on the friction rod constant, at least two guide rollers are preferably provided offset from a position of the friction roller in the recording device 12. In this way, by using a so-called Euler's belt theory, a tension acting on the medium 99 between the friction rod and the recording device 12 in the feeding direction of the medium 99 can be sufficiently greater than a tension acting on the medium 99 between the friction rod and the holding device 15. As a result, even when the tension acting on the medium 99 between the friction rod and the holding device 15 fluctuates by the size of the first roll body R1 decreasing as the medium 99 is used, an influence of the fluctuation is absorbed in a sufficiently great tension acting on the medium 99 between the friction rod and the holding device 15, and the tension acting on the medium 99 between the friction rod and the recording device 12 can be substantially constant.

Note that the structure of the tension adjustment device 16 is not particularly limited as long as the structure has an effect of making the tension of the medium 99 between the recording device 12 and the holding device 15 substantially constant.

The recording device 12 is not be limited to setting a set value from three of the first set value, the second set value, and the third set value, and may be configured so as to set a set value from four or more values.

The liquid discharged by the recording unit 22 is not limited to ink, and may be, for example, a liquid material including particles of a functional material dispersed or mixed in liquid. For example, the recording unit 22 may discharge a liquid material including a material such as an electrode material or a pixel material used in manufacture of a liquid crystal display, an electroluminescent (EL) display, and a surface emitting display in a dispersed or dissolved form.

Hereinafter, technical concepts and effects thereof that are understood from the above-described exemplary embodiments and modified examples will be described.

(A) A recording system includes a recording device including a recording unit configured to perform recording onto a medium, a transporting belt including an adhesive layer and configured to transport the medium stuck on the adhesive layer, a drive unit configured to drive the transporting belt, a control unit that includes a detection unit configured to detect a load current flowing in the drive unit, and that controls the drive unit. The recording system further includes a peeling device configured to peel the medium from the transporting belt, and a notification device configured to provide a notification, where the control unit causes the notification device to provide a notification on a time to replace the adhesive layer, based on a detection result of the detection unit.

When the medium is peeled from the transporting belt by the peeling device, a load is generated on the drive unit. The load generated on the drive unit appears as a load current flowing in the drive unit. The load generated on the drive unit increases as an adhesive force of the adhesive layer increases. Thus, the load current increases as the adhesive force of the adhesive layer increases. In other words, when the adhesive force of the adhesive layer decreases, the load current decreases.

According to the configuration described above, the control unit can detect the adhesive force of the adhesive layer by detecting the load current flowing in the drive unit. In other words, the control unit can detect the adhesive force without affecting the adhesive layer. Therefore, the recording system can detect the adhesive force without decreasing the adhesive force of the adhesive layer.

(B) In the recording system described above, the notification device may include a display unit configured to display information, and an input unit configured to receive an input of an instruction, and the control unit, when completion of replacement of the adhesive layer is input to the input unit, may detect the load current flowing in the drive unit in a case in which the medium is peeled from the transporting belt by the peeling device, in a state where an operation of the recording unit is stopped.

According to this configuration, when the adhesive layer is replaced, the control unit detects the adhesive force of the replaced new adhesive layer. In other words, the control unit detects an initial value of the adhesive force of the new adhesive layer. As a result, the control unit can detect a degree of decrease in the adhesive force with reference to the initial value of the adhesive force.

(C) In the recording system described above, the notification device may include a display unit configured to display information, and an input unit configured to receive an input of an instruction, the control unit may cause the notification device to provide a notification for prompting replacement of the adhesive layer when the load current is equal to or less than a set value, and the set value may be changeable through the input unit.

According to this configuration, timing for prompting replacement of the adhesive layer is changed by changing the set value. As a result, usability of a user improves.

(D) The recording system described above may include a holding device configured to hold a roll body on which the medium is wound, and a tension adjustment device configured to adjust a tension of the medium between the holding device and the recording device to be constant, where the medium may be unwound from the roll body, which is held by the holding device, by driving the transporting belt.

The medium is unwound from the roll body by driving the drive unit. As a result, a load is generated on the drive unit by unwinding the medium from the roll body. At this time, due to the moment of inertia, it is more difficult to rotate the roll body with a greater weight of the roll body. In other words, a load generated on the drive unit is more likely to increase with a greater remaining amount of the medium.

In this regard, according to the configuration described above, by the tension adjustment unit adjusting a tension of the medium to be constant, a load generated on the drive unit is constant by the medium being unwound from the roll body regardless of the remaining amount of the medium. As a result, the control unit can accurately detect the adhesive force, based on a load current.

(E) A recording device is a recording device in which a medium is collected by a peeling device, and includes a recording unit configured to perform recording onto the medium, a transporting belt including an adhesive layer and configured to transport the medium stuck on the adhesive layer, a drive unit configured to drive the transporting belt, a control unit including a detection unit configured to detect a load current flowing in the drive unit, and configured to control the drive unit, and a notification unit configured to provide a notification, where the control unit causes the notification unit to provide a notification on a time to replace the adhesive layer, based on the load current flowing in the drive unit when the medium is peeled from the transporting belt.

According to the configuration described above, an effect similar to that of the recording system described above is acquired.

(F) A control method is a control method for a recording device including a recording unit configured to perform recording on a medium, a transporting belt including an adhesive layer and configured to transport the medium stuck on the adhesive layer, and a drive unit configured to drive the transporting belt, and includes detecting a load current flowing in the drive unit when the medium is peeled from the transporting belt, and providing a notification on a time to replace the adhesive layer, based on a value of the detected load current.

According to this method, an effect similar to that of the recording system and the recording device described above is acquired.

What is claimed is:

1. A recording system, comprising:

a recording device including a recording unit configured to perform recording onto a medium, a transporting belt including an adhesive layer and configured to transport the medium stuck on the adhesive layer, a drive unit configured to drive the transporting belt;

a control unit that includes a detection unit configured to detect a load current flowing in the drive unit and that is configured to control the drive unit, a peeling device configured to peel the medium from the transporting belt and a notification device configured to provide a notification, wherein the control unit causes the notification device to provide a notification on a time to replace the adhesive layer, based on a detection result of the detection unit.

2. The recording system according to claim 1, wherein the notification device includes a display unit configured to display information, and an input unit configured to receive an input of an instruction, and the control unit, when completion of replacement of the adhesive layer is input to the input unit, detects the load current flowing in the drive unit in a case in which the medium is peeled from the transporting belt by the peeling device, in a state where an operation of the recording unit is stopped.

3. The recording system according to claim 1, wherein the notification device includes a display unit configured to display information, and an input unit configured to receive an input of an instruction, the control unit causes the notification device to provide a notification for prompting replacement of the adhesive layer when the load current is equal to or less than a set value, and the set value is changeable through the input unit.

4. The recording system according to claim 1, comprising:

a holding device configured to hold a roll body on which the medium is wound; and a tension adjustment device configured to adjust a tension of the medium between the holding device and the recording device to be constant, wherein the medium is unwound from the roll body, which is held by the holding device, by driving the transporting belt.

5. A recording device in which a medium is collected by a peeling device, the recording device comprising:

a recording unit configured to perform recording onto the medium;

a transporting belt including an adhesive layer and configured to transport the medium stuck on the adhesive layer;

a drive unit configured to drive the transporting belt;

a control unit including a detection unit configured to detect a load current flowing in the drive unit, and configured to control the drive unit; and a notification unit configured to provide a notification, wherein the control unit causes the notification unit to provide a notification on a time to replace the adhesive layer, based on the load current flowing in the drive unit when the medium is peeled from the transporting belt.

6. A control method for a recording device including a recording unit configured to perform recording onto a medium, a transporting belt including an adhesive layer and configured to transport the medium stuck on the adhesive layer, and a drive unit configured to drive the transporting belt, the control method comprising:

detecting a load current flowing in the drive unit when the medium is peeled from the transporting belt; and providing a notification on a time to replace the adhesive layer, based on a value of the detected load current.

* * * * *